United States Patent [19]

McNeill

[11] Patent Number: 4,960,509

[45] Date of Patent: Oct. 2, 1990

[54] ORE FLOTATION DEVICE AND PROCESS

[75] Inventor: Harry L. McNeill, Tempe, Ariz.

[73] Assignee: Colorado School of Mines, Golden, Colo.

[21] Appl. No.: 380,984

[22] Filed: Jul. 17, 1989

[51] Int. Cl.[5] ..... B03D 1/16; B03D 1/22

[52] U.S. Cl. ..... 209/164; 209/169; 261/87

[58] Field of Search ..... 209/164, 169, 170, 168; 261/87; 210/219

[56] References Cited

U.S. PATENT DOCUMENTS

| | | | |
|---|---|---|---|
| 1,283,159 | 10/1918 | Groch | 209/169 |
| 1,285,061 | 11/1918 | Daman | 209/169 |
| 1,314,316 | 8/1919 | Flinn | 209/170 |
| 1,374,446 | 4/1921 | Greenwalt | 209/169 |
| 1,374,499 | 4/1921 | Greenwalt | 209/169 |
| 1,402,099 | 1/1922 | Shimmin | 209/169 |
| 1,471,332 | 10/1923 | Greenwalt | 209/169 |
| 1,881,412 | 10/1932 | MacCamy | 209/169 |
| 2,141,862 | 12/1938 | Hall | 209/169 |
| 2,174,540 | 10/1939 | Wallace | 209/169 |
| 2,226,170 | 12/1940 | Lasseter | 209/169 |
| 2,269,583 | 1/1942 | Dromgold | 209/169 |
| 2,466,037 | 4/1949 | McNeill | 209/169 |
| 2,928,543 | 3/1960 | Logue | 209/169 |
| 3,071,447 | 1/1963 | Bernhardi | 209/169 |
| 3,202,281 | 8/1965 | Weston | 209/169 |
| 3,393,802 | 7/1968 | Logue | 209/169 |
| 3,393,803 | 7/1968 | Daman | 209/169 |
| 3,490,589 | 1/1970 | Cumbulisty | 209/169 |

OTHER PUBLICATIONS

"Semi-autogenous grinding?", Harry L. McNeill, *International Mining*, Jul. 1989, pp. 12–13.

*Mineral Processing Technology*, Second Edition (1981), by B. A. Wills, Chapter 12, pp. 355–370.

"Considerations for Improving the Performance of Froth Flotation Systems," by Richard R. Klimpel, Dec. 1988, *Mining Engineering*, pp. 1093–1100.

*Improving the Effectiveness of Flotation*, by V. I. Tyurnikova and M. E. Naumov, pp. 181–208.

*The Handbook of Mineral Dressing*, by Arthur Taggart, pp. 12–52 thru 12–73 (1945).

*Flotation*, by T. Metally, pp. 280–307 (1983).

*Chemical Engineer's Handbook*, Fifth Edition, edited by R. H. Perry and C. H. Chilton, pp. 21–65 through 21–69.

*Primary Examiner*—David L. Lacey

*Assistant Examiner*—Thomas M. Lithgow

*Attorney, Agent, or Firm*—Sheridan, Ross & McIntosh

[57] ABSTRACT

A mineral processing device for floating relatively large particles and middling particles is disclosed. The device provides a uniform upward flow of pulp in a flotation zone. Gas bubbles are introduced into the pulp with minimal agitation. Agitation in the flotation zone is also controlled by a plate with a multitude of holes of varying size. The upward flow velocity in the flotation zone is controlled by means of a variable speed impeller and an adjustable partition. Further, a flotation process utilizing uniform upward flow is provided.

14 Claims, 4 Drawing Sheets

ORE FLOTATION DEVICE AND PROCESS

FIELD OF THE INVENTION

The present invention relates to flotation devices having the capability to float middling and relatively large ore particles in a uniform upward flow that counteracts the adverse effect of gravity. Further, the invention relates to a process to separate selected minerals from undesired gangue, preferably utilizing banks of flotation devices.

BACKGROUND OF THE INVENTION

One of the major tasks in mineral recovery involves the separation of the desired mineral from the ore in which it is contained. Froth flotation is one of the most common techniques used for this purpose. In this technique, crushed ore is placed into a froth flotation tank. The chemical and physical properties of the fluid in the froth flotation tank are adjusted such that the desired ore particles can preferentially attach to bubbles which are rising upward through the fluid in the flotation tank.

One of the major problems associated with the froth flotation technique is the inability of the technique to float relatively large particles. B. A. Wills, in "Mineral Processing Technology", Second Edition, pp. 316–370, Pergamon Press (1981), teaches that the froth flotation process can only be applied to relatively fine particles. If the particles are too large, then the adhesion between the particle and the bubble will be less than that of the particle weight and the bubble will drop its load. Wills also teaches the advantages of floating a mineral as coarse as possible. These advantages include; lower grinding costs, increased recovery due to decreased slime losses, fewer overground particles, increased metallurgical efficiency, less flotation equipment, and increased efficiency in thickening and filtration stages. While the particle size that can be floated will vary with the specific mineral type, Wills discloses that the upper size limit is normally about 300 micrometers in diameter.

Flotation systems are discussed by Richard R. Klimpel in an article entitled "Considerations for Improving the Performance of Froth Flotation Systems", Mining Engineering, pp. 1093–1100, December, 1988. In the article, R. R. Klimpel segments the flotation system into three groups of components. The first group, chemistry components, includes collectors, frothers, activators, depressants and pH. The second group, operation components, includes feed rate, mineralogy, particle size, pulp density and temperature. The third group, equipment components, includes cell design, agitation, air flow, cell bank configuration and cell bank control. Regarding particle size, Klimpel points out "the greater the amount of large or small particles, or of both large and small, the more difficult it is to achieve excellent flotation results" Klimpel recognizes that "significant departures from existing highly agitated, short-mean-path particle fall designs are necessary" in order to change certain flotation results. However, no specific cell designs are disclosed.

While many variations exist on the market, froth flotation machines can be divided into two general categories. These categories are the pneumatic machines and the mechanical, or sub-aeration machines.

In a pneumatic machine, air is used to produce a froth and create aeration. Further, the air maintains the suspension and circulates it. Hence, an excessive amount of air is introduced into the system to achieve both of these goals. Improvements have been made on the basic design. For example, in the Davcra cell, pulp is pumped into the bottom by a cyclone and is dissipated against a baffle. Dispersion of the air and collection of particles occurs in a highly agitated zone. The tailings exit the machine at the bottom. In a flotation column design, water moves downward with particles to contact the bubbles which rise upward into the froth to be removed. Again, tailings are removed from the bottom. The flotation column is said to work best on relatively fine particles.

In a mechanical, or sub-aeration cell, incoming air is divided into air bubbles prior to being diffused through the pulp. For example, in the Denver Sub-A machine, an impeller shears the air stream into fine bubbles, while simultaneously drawing pulp into the cell to intimately mix with the bubbles. The bubbles then rise in a quiescent zone, so agitation does not cause bubbles to drop their load. In the Denver DR machine, pulp is passed through a circulation pump while air is pressure fed through a casing pipe. The aerated pulp stream rises, and prior to reaching the froth layer level, the pulp passes through a circulation pump and returns to the impeller. In the Wemco-Fagergren cell, the impeller is replaced by a rotor-disperser assembly. Pulp is drawn into the rotor by a suction action, and air is drawn from above. The two are intimately mixed as the disperser breaks the mixture into smaller bubbles. These bubbles then rise into the froth and are removed from the system.

Conventional flotation systems typically do not provide the critical upward flow velocity required for the flotation of large particles. Typically, flotation systems rely on the adhesive forces between the bubble and particle to overcome the force of gravity pulling downward on the particle. As a result, relatively large particles are not able to be floated. Additionally, due to inadequate bubble attachment, prior art devices typically cannot float middling particles. As used herein, the term "middling" refers to those particles which contain minor amounts of desirable mineral attached to undesirable gangue. Because the bubbles selectively attach to the mineral in typical flotation processes, the area for attachment in a middling particle is relatively small. As a result, middling particles typically do not float well in prior art devices. Also, in some cases, collection of particles takes place in a highly agitated zone. As a result, particles are often knocked loose from the bubbles supporting them, resulting in loss of efficiency. Further, paddles must typically be employed to remove the froth.

Therefore, it would be advantageous to produce a flotation device with the ability to float relatively large particles as well as middling. Further, it would be advantageous to decrease the amount of agitation in the flotation zone. It would also be advantageous to produce a flotation device in which froth can be removed without the use of mechanical devices such as froth paddles.

SUMMARY OF THE INVENTION

In accordance with the present invention, a flotation device and a flotation process are provided. The method and apparatus of the present invention provide numerous advantages, including the ability to float middling particles and mineral particles of relatively large size, when compared to methods and apparatus of the prior art.

In a preferred embodiment of the present invention, a flotation device is provided having at least two zones. The first zone, which will be termed the "flotation zone", is preferably located near an outer wall of the flotation device. The second zone, termed the "feed zone", is preferably centrally located in the flotation device. Pulp, containing solid ore particles in a liquid carrier, is initially introduced into the feed zone. Preferably, a movable partition separates the flotation zone from the feed zone. The movable partition permits adjustment of the cross-sectional area of the flotation zone.

A device, such as an impeller, is provided in order to circulate the pulp through the flotation device. The impeller draws the pulp in the feed zone in a downward direction until it reaches the bottom of the flotation device, where it flows outwardly toward the flotation zone and then in an upward direction through the flotation zone. Preferably, the impeller is driven by a variable speed motor in order to provide for the regulation of the flow of the pulp through the flotation device.

A device is provided near the bottom of the flotation zone in order to reduce agitation in the flotation zone. This device can consist of a plate, such as a bubble plate, having a plurality of holes. Preferably, the holes are of varying sizes, with the larger holes located adjacent to the outer wall of the flotation device. The smaller holes in the plate are located adjacent the movable partition which separates the flotation zone from the feed zone. Other devices, such as baffles, etc., can also be employed.

A gas, such as air, is introduced into the flotation device in order to create a large amount of bubbles within the flotation zone. Preferably, the gas is introduced through a pipe to a location near the impeller, which disperses the gas into a multitude of fine bubbles. The bubbles flow along with the pulp into the flotation zone. Within the flotation zone, the desired ore becomes selectively attached to the gas bubbles.

The bubbles, along with the attached particles, form a froth. A froth discharge area is provided above the flotation zone through which the froth is removed from the flotation device. Preferably, the froth exits the flotation zone with sufficient velocity to escape through the froth discharge area without the aid of mechanical means such as froth paddles.

The remainder of the pulp, which is not floated in the froth, flows over the top of the partition separating the flotation zone from the feed zone and returns to the feed zone. A portion of this pulp is recirculated through the flotation device and the remainder exits the flotation device, for example, over a weir. Preferably, the upper portion of the partition between the flotation zone and the feed zone is provided with an adjustable weir in order to regulate the flow of pulp from the flotation zone to the feed zone.

A preferred embodiment of the process of the present invention includes the step of creating a uniform upward flow in a flotation zone of a flotation device. Gas, such as air, is introduced into the flotation device in order to create a large amount of bubbles in the flotation zone. Desired particles in the uniformly upward-flowing pulp become attached to the gas bubbles and are removed from the flotation device as a froth. The remainder of the pulp is either recirculated through the flotation device or is removed from the flotation device.

In order to obtain the flotation of the desired particles, a number of parameters can be regulated. For example, the cross-sectional area of the flotation zone can be adjusted in order to control the velocity of the uniform upward flow of the pulp. The speed of the impeller can also be adjusted in order to vary the pulp flow velocity. Additionally, the height of the weir separating the flotation zone from the feed zone can be adjusted. Further, the amount of gas introduced can be adjusted in order to create the proper amount of gas bubbles within the flotation device. Additionally, the cross-sectional area and the weir height of the froth discharge area can be adjusted in order to control the velocity of the froth discharge. The volume of pulp introduced into the flotation cell, as well as the amount of pulp removed, can also be controlled as desired.

DETAILED DESCRIPTION OF THE INVENTION

Figure 1:
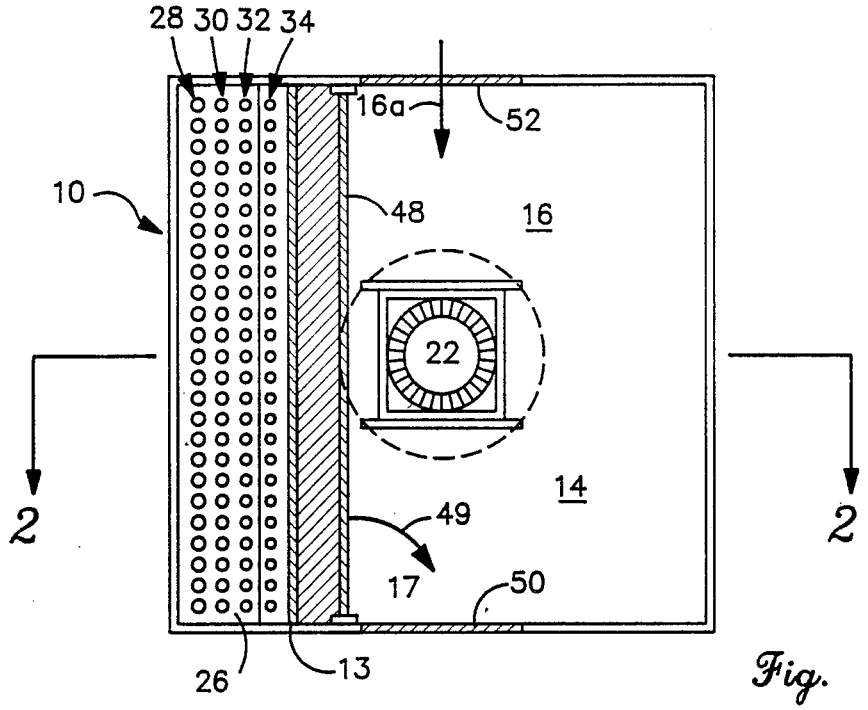
FIG. 1 illustrates a top view of one embodiment of a flotation device according to the present invention.
Figure 2:
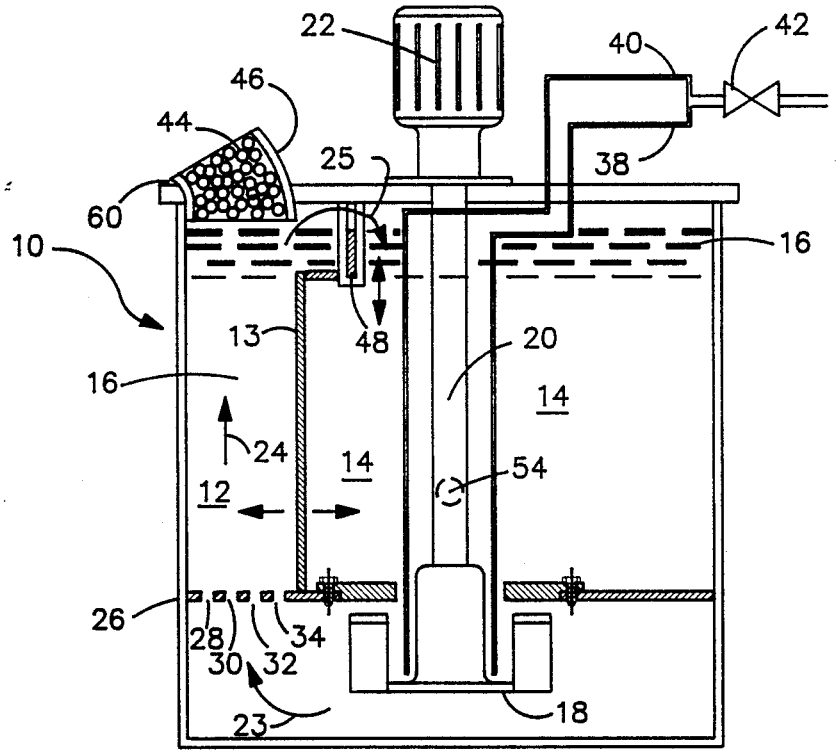
FIG. 2 illustrates a side sectional view of the device of FIG. 1 taken along line 2—2.

The present invention will be described with reference to the accompanying drawings. FIG. 1 and FIG. 2 illustrate top and side views, respectively, of a preferred embodiment of the flotation device. The flotation device 10 includes a flotation zone 12 and a feed zone 14. A movable partition 13 separates the flotation zone 12 from the feed zone 14. The movable partition 13 permits the horizontal cross-sectional area of the flotation zone 12 to be adjusted as desired. The movable partition 13 can be secured in one of a various number of positions by means known in the art. For example, the movable partition 13 can be secured within slots (not shown) incorporated into the walls of the device 10. Alternatively, the movable partition 13 can be selectively fastened to the walls by way of fasteners such as bolts, screws, clamps, etc.

During use, pulp 16 comprising crushed ore and a liquid such as water is introduced into device 10. For example, the pulp 16 can be introduced over wier 52 as shown by arrow **16*a* in FIG. 1. The upper level of the pulp 16 is indicated by dashed lines in FIGS. 2 and 4. The pulp 16 is circulated through the device 10 by the action of an impeller 18. The impeller 18 is connected by way of a shaft 20 to a variable speed motor 22. The spinning impeller 18 circulates the pulp 16 in the direction of arrows 23, 24 and 25. The pulp 16 passes through plate 26 which has a plurality of rows of holes 28, 30, 32 and 34 of varying sizes. The size of the holes are selected to secure a uniform upward flow. Naturally, more or less than four rows can be employed. The plate 26 controls or reduces agitation in the flotation zone 12** in order to create a uniform upward flow in the direction of the arrow 24.

Gas (not shown), such as air, is introduced into the flotation device 10 by way of one or more air pipes 38 and 40. Preferably the amount of gas is controlled by a single valve 42 although an individual control valve can be used for each pipe. The gas is introduced relatively close to the impeller 18 where the rotational action of the impeller 18 causes the formation of many fine bubbles (not shown). The bubbles follow the pulp flow 23 into the flotation zone 12. Preferably, the rows of holes 28, 30, 32 and 34 in plate 26 are of varying sizes with row 28 having the largest holes and row 34 having the smallest holes. This allows the larger amount of bubbles to flow upward through flotation zone 12 adjacent to the outer wall.

Desired solid materials (not shown) selectively attach to the bubbles. Typically, the desired solid materials comprise the desired concentrate, for example, minerals or coal. However, in what is commonly referred to as "reverse flotation," floated materials are the gangue and the non-floated materials comprise the desired concentrate. Therefore, as used herein, the term "desired solid materials" are those materials which are being floated. The solid materials attached to the bubbles form a froth 44 on the surface of the pulp 16. The froth 44 is drawn off through a froth discharge area 46 (shown in phantom in the top views of FIGS. 1 and 3). Because the majority of the bubbles are preferably adjacent to the outer wall, froth discharge efficiency is increased.

The remainder of the pulp 17 flows over the weir 48 and is recycled through the device 10 through feed zone 14 in the direction of arrow 25 or flows out of the device 10 in the direction of arrow 49 over weir 50. The pulp 17 which flows out of the device 10 is replaced by new pulp 16, for example, from a previous cell (not shown) over weir 52. A sand hole 54 is provided to prevent the buildup of solids at the bottom of the flotation device 10.

Figure 3:
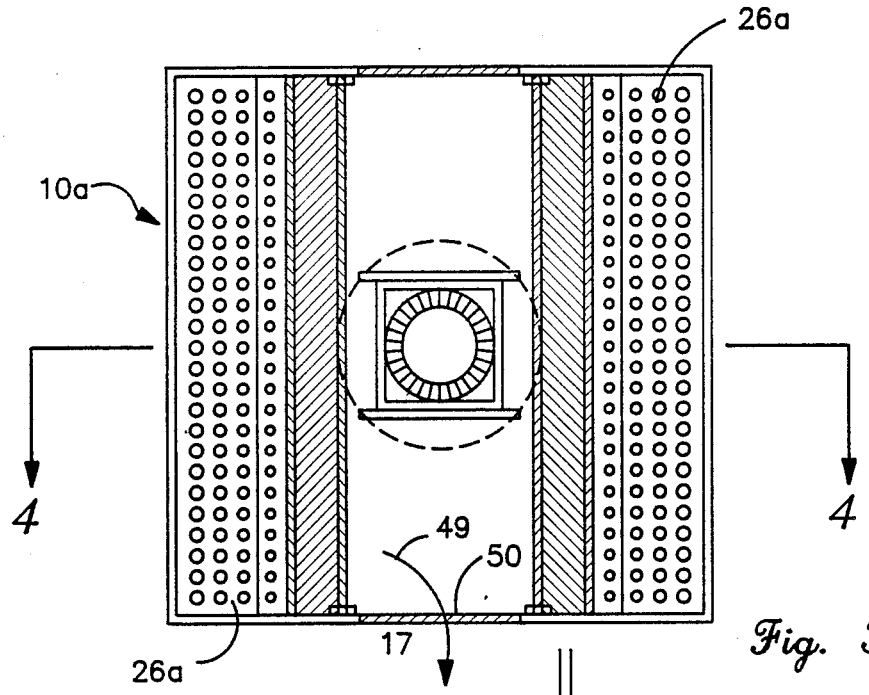
FIG. 3 illustrates a top view of another embodiment of a flotation device according to the present invention.
Figure 4:
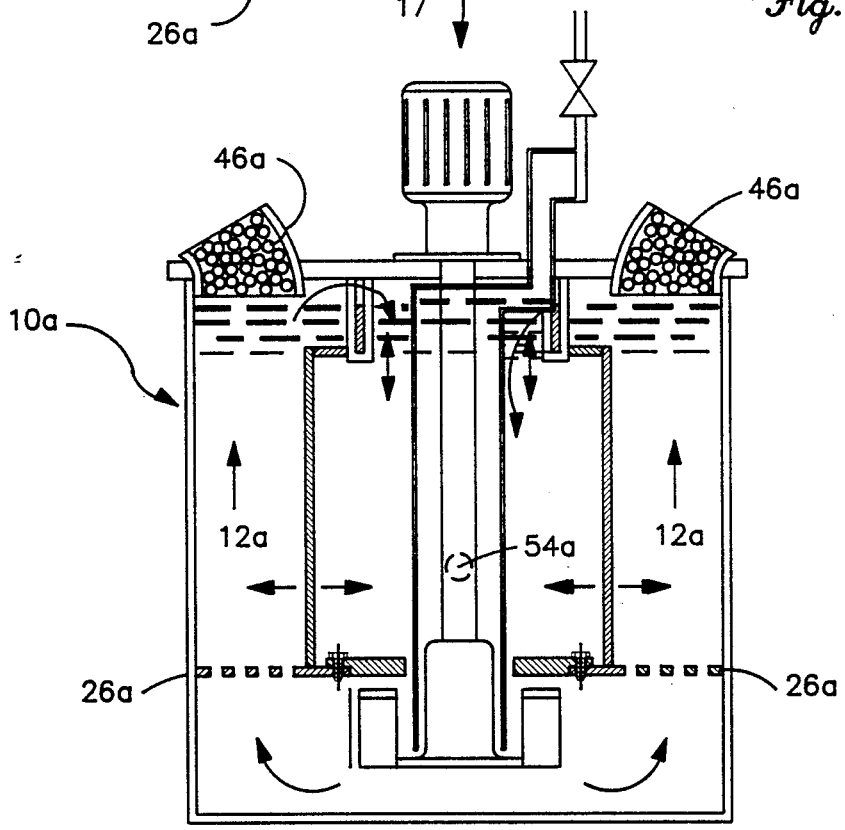
FIG. 4 illustrates a side sectional view of the flotation device shown in FIG. 3 taken along line 4—4.

As can be appreciated by those skilled in the art, configurations other than those shown in FIGS. 1 and 2 can be employed. For example, as shown in FIGS. 3 and 4, a device **10*a* is provided having two flotation zones 12*a*. The two flotation zones 12*a* are located along opposite walls of the square flotation device 10*a*. The elements of the flotation device shown in FIGS. 3 and 4 are substantially similar to those described in connection with FIGS. 1 and 2. A sand hole 54*a*** is provided to prevent the build up of solids at the bottom of the flotation device.

Figure 5:
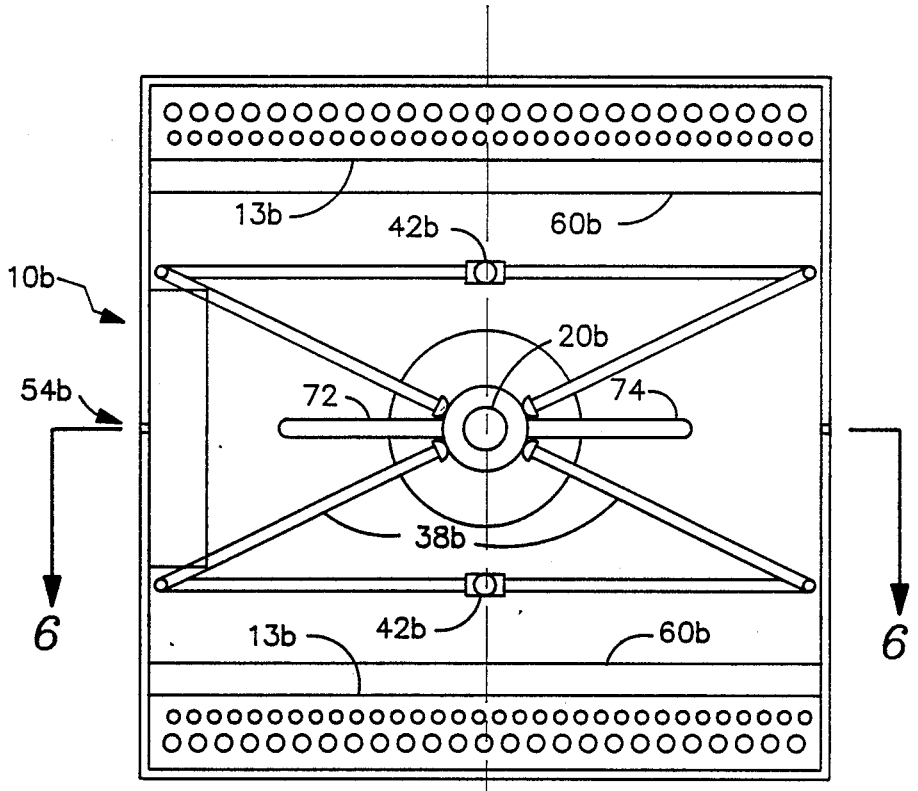
FIG. 5 illustrates a top view of yet another embodiment of a flotation device according to the present invention.
Figure 6:
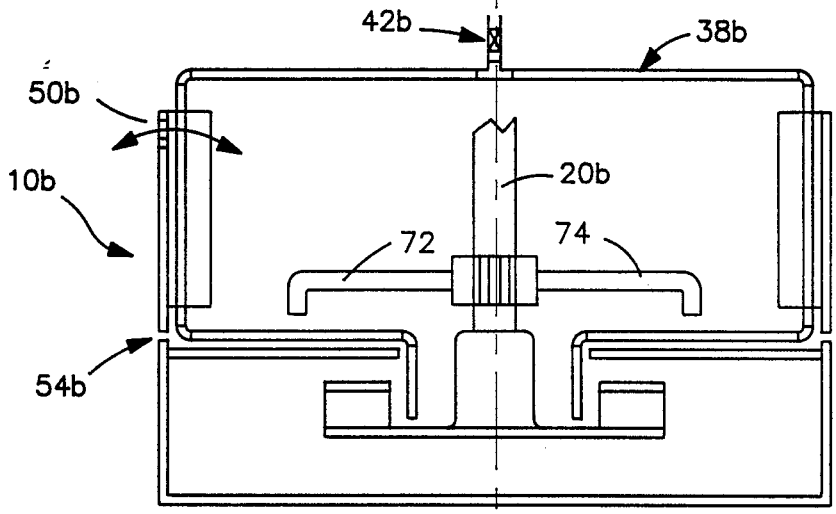
FIG. 6 illustrates a side sectional view of the flotation device shown in FIG. 5 taken along line 6—6.

In order to keep the sand hole from becoming blocked with large particles, a device can be provided to create agitation near the sand hole. For example as illustrated in FIGS. 5 and 6, sand agitator bars 72 and agitation near the sand hole **54*b* as the shaft 20*b* spins. The bars 72 and 74 can be fabricated from appropriate materials, e.g., 1 inch diameter metal rods. The size of the bars 72 and 74 can be selected by one skilled in the art. Naturally, the air pipes 38*b* and 42*b* are positioned in order to prevent interference with the bars 72 and 74. For clarity of illustration, a froth discharge area is not shown in FIGS. 5 and 6. As an alternative to bars 72 and 74**, a tube (not shown) can be provided with an outlet end located near the sand hole. Liquid or gas is forced through the tube to create agitation near the sand hole and thus keep it clear of debris.

While not wishing to be bound by any theory of operation, it is believed that the uniform upward flow of pulp in the flotation zone of the present device counteracts the downward force of gravity on the particles. The greater the velocity of the uniform upward flow, the heavier the particles which can be floated. Prior art devices typically do not provide the critical velocity required for the flotation of relatively large particles. Particles and bubbles flow upwardly in the flotation zone. The desired particles selectively attach to the bubbles. Because agitation is controlled, it is less likely that the particles will become detached from the bubbles. Even if detachment occurs, the volume of bubbles can be adjusted so that other bubbles are available for reattachment.

The velocity of the upward pulp flow, combined with increased bubble attachment, results in a relatively high upward velocity for the floated particles. The velocity of the pulp 16 in the flotation zone 12 is selected so as to counteract the effect of gravity on the particles which are floated. A higher velocity permits the flotation of larger particles. The velocity can be determined by one skilled in the art to obtain a desired result. For example, for the cleaner cells illustrated in FIG. 7 and discussed in more detail hereinbelow, the velocity can be from about 8 to about 10 feet per second.

Preferably, the upward velocity permits the froth 44 (see FIG. 2) to be carried out through a froth discharge area 46 without the aid of mechanical means to remove the froth 44. Therefore, the need for a froth skimmer or paddle is reduced or eliminated. The velocity of the froth discharge can be controlled by adjusting the cross-sectional area of the froth discharge area 46, as well as the height of the froth discharge area weir 60.

By increasing the flow of bubbles and decreasing the agitation in the first portion 12 of the flotation device 10, the desired particles selectively attach to the bubbles more effectively. This permits the flotation of middling ore, i.e. gangue ore particles which include minor amounts of desired mineral attached thereto.

Figure 7:
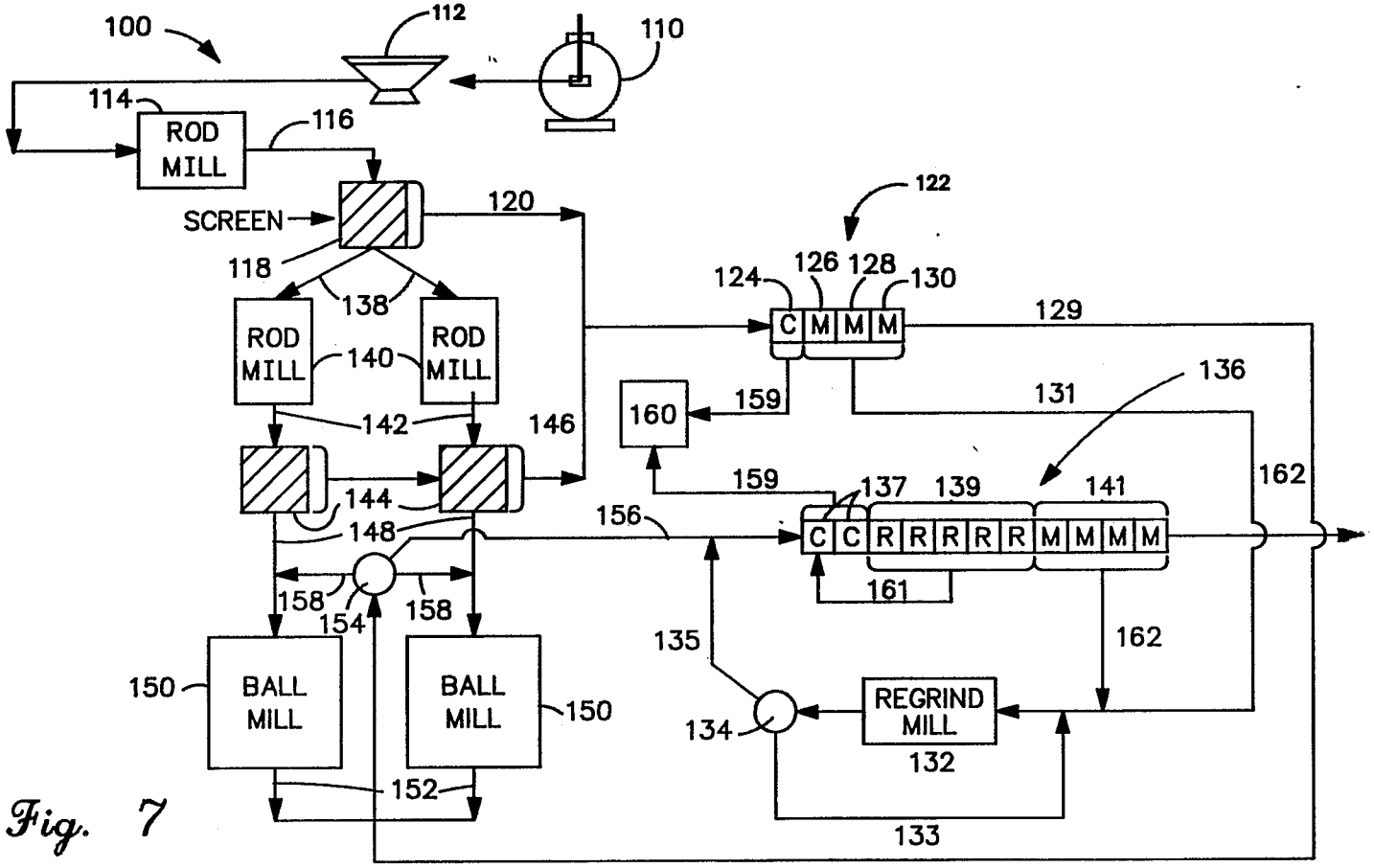
FIG. 7 illustrates a flow sheet for an ore benefication process employing the apparatus and process of the present invention.

The apparatus and method of the present invention can be used in a complete ore benefication process 100, as illustrated in FIG. 7. Ore is first subjected to primary and secondary crushers, 110 and 112 respectively, and a rod mill 114 in a manner well known in the art. The crushed and milled ore 116 is then screened 118. Ore 120 which is smaller than a certain size, e.g. minus 20 mesh, is fed to a first series of flotation cells 122. The size of the ore which is sent to the first series 122 will vary depending on the particular ore. For example, it is contemplated that for coal and non-sulphide minerals, the particles will be larger than minus 20 mesh.

This first series of flotation cells 122 includes a cleaner flotation cell 124 and middling flotation cells 126, 128 and 130. The cleaner flotation cell 124 is designed to separate relatively pure mineral from the remainder of the ore. The mineral 159 is sent to appropriate further processing 160, e.g. mineral refinement. In the middling cells 126, 128 and 130, ore particles containing minor amounts of mineral (i.e. middling particles) are separated from the gangue.

The same basic flotation cell design can be used for both cleaner cells and middling cells. The different types of ore particles are floated by varying certain parameters. For example, the upward flow of the pulp in the flotation zone is typically increased in order to float middling particles. The velocity of the upward flow can be increased by either increasing the impeller speed or by decreasing the cross-sectional area of the flotation zone. Other parameters which can be adjusted include the size of the holes in the bubble plates, the cross-sectional area of the froth discharge area, the weir height of the froth discharge area, and the height of the overflow weir separating the flotation zone from the feed zone in order to obtain the desired flotation results. Additionally, the gas flow rate can be adjusted in order to control the amount of bubbles within the flotation zone. For example, the middling cells 126, 128 and 130 are designed to have higher gas bubble flow rates in order to more effectively float the middling ore.

It should be noted that a number of other factors can affect flotation results. For example, chemicals such as frothers, collectors, activators, depressants, etc., can be selected and added to the pulp as appropriate by those skilled in the art to obtain desired results. Additionally, operation factors such as feed rate, mineralogy, pulp density and temperature can be controlled.

The floated middling particles 131 are sent to a regrind mill 132 in order to liberate the mineral from the gangue. A cyclone separator 134 is positioned after the regrind mill 132, with the underflow 133 being recycled through the regrind mill 132 and the overflow 135 being sent to a secondary flotation series 136. Unfloated pulp 129 from the primary flotation series 122 is sent to a cyclone separator 154.

The secondary flotation series 136 is made up of cleaner flotation cells 137, rougher flotation cells 139 and middling flotation cells 141. All three types of cells are of similar basic design. Various process and mechanical parameters can be adjusted in order to achieve the various desired flotation results. The cleaner cells 137 of the secondary flotation series 136 operate in a manner analogous to the cleaner cell 124 of the primary flotation series 122. However, the secondary flotation series 136 is designed to float relatively smaller particles, e.g., minus 35 mesh. The rougher flotation cells 139 are designed to float mineral particles which make it through the cleaner flotation cells 137. The middling flotation cells 141 are designed to float middling particles.

Oversized ore 138 from screen 118 is sent to rod mills 140 for further reduction in size. The milled ore 142 is screened 144 and ore 146 less than a certain size, e.g., minus 20 mesh, is sent through the primary flotation series 122. The oversized ore 148 is ball milled 150. The ball milled ore 152 is subjected to cyclone separation 154 with the overflow 156 going through the secondary flotation series 136. The underflow 158 is recycled through the ball mills 150. The liberated mineral particles 159 from the cleaner cells 137 are set to processing 160. The floated particles 161 from the rougher cells 139 are recycled to cleaner cells 137. In this manner, the rougher concentrate 161, which typically contains undesirable rock slimes, is upgraded in the cleaner cells 137. The upgraded concentrate from the cleaner cells 159 is then sent to processing 160, for example mineral refinement. The middling particles 162 are sent to a regrind mill 132 for liberation of the mineral and eventually further processing in the secondary flotation series 136. The tails 162 are disposed of as appropriate.

While various embodiments of the present invention have been described in detail, it is apparent that modifications and adaptation of those embodiments and adaptations are within the spirit and scope of the present invention, as set forth in the following claims.

What is claimed is:

1. A flotation device comprising (a) a flotation vessel;

(b) a flotation zone of substantially uniform cross-sectional area located within said flotation vessel, wherein the perimeter of said flotation zone is defined by walls and the upper and lower ends of said flotation zone are at least partially open to permit flow therethrough;

(c) a feed zone located within said flotation vessel adjacent said flotation zone and separated therefrom by a vertical baffle, said baffle being part of the walls that define said flotation zone, said baffle extending from the lower end of the flotation zone to the upper end of the flotation zone thereby defining the upper and lower ends of said flotation zone, the lower end of said baffle being spaced from the bottom of the vessel thereby defining a lower passage through which pulp can flow into said flotation zone, the upper end of said baffle being located below the upper edge of the vessel walls thereby defining an upper passage for pulp to flow over the top of the baffle and into said feed zone;

(d) an agitation reducing plate having holes therein and located at or near the lower end of said baffle;

(e) means located within said flotation vessel for circulating pulp through said flotation vessel, wherein said pulp flows substantially from said circulating means through said lower passage and upward through said agitation reducing plate into said flotation zone and continues to flow in an upward direction from the lower end of said flotation zone to the upper end of said flotation zone;

(f) means for introducing gas bubbles into said flotation vessel, wherein said gas bubbles travel through said lower passage and upwardly from the lower end to the upper end of said flotation zone and desired particles become attached to the gas bubbles in said flotation zone; and (g) means for discharging froth located directly above the upper end of said flotation zone.

2. A flotation device as claimed in claim 1 further comprising means to control the velocity of a froth discharge.

3. A flotation device as claimed in claim 1 wherein said plate contains holes of varying sizes.

4. A flotation device as claimed in claim 1 comprising means to vary the velocity of said pulp flowing in a substantially uniform upward direction in said flotation zone.

5. A flotation device as claimed in claim 4 wherein said means to circulate and said means to vary the velocity of said pulp comprise an impeller driven by a variable speed rotation means.

6. A flotation device as claimed in claim 1 further comprising means to uniformly vary the cross-sectional area of said flotation zone.

7. A flotation device as claimed in claim 6, wherein said means for uniformly varying the cross-sectional area of said flotation zone comprises means for adjusting said vertical baffle in a lateral direction toward or away from a wall of said flotation vessel in order to uniformly decrease or increase the cross-sectional area of the flotation zone.

8. A flotation device as claimed in claim 1, comprising:

(a) means to adjustably support said vertical baffle located inside said flotation vessel.

9. A flotation device as claimed in claim 8 wherein said holes are of at least two different sizes, and holes having a larger diameter are located further away from said vertical baffle and holes having a smaller diameter are located nearer said vertical baffle.

10. A flotation device comprising:

(a) a flotation vessel, (b) a flotation zone located adjacent an outer wall of and within said flotation vessel, wherein the perimeter of said flotation zone is defined by walls, including said outer wall of said flotation vessel and the upper and lower ends of said flotation zone are at least partially open to permit flow therethrough, (c) a feed zone within said flotation vessel, separated from said flotation zone by a vertical partition in which the lower end of said partition being spaced from the bottom of the vessel thereby defines a lower passage through which pulp can flow into said flotation zone, means for adjusting the vertical partition in a lateral direction thereby permitting the cross-sectional area of the flotation zone to be uniformly varied, (d) a plate located near said lower end of said flotation zone in the path of flow between said feed and said flotation zone, said plate having holes of at least two diameters wherein the larger of said holes are located near said outer wall and the smaller of said holes are located near said laterally adjustable partition which separates said flotation zone from said feed zone, (e) an impeller within said flotation vessel for circulating pulp in said flotation vessel and means for rotating said impeller at variable speeds, (f) weir means separating the upper end of said flotation zone from said feed zone, means for vertically adjusting said weir means, (g) froth discharge means at the upper end of the vessel, (h) gas input means for creating gas bubbles within said flotation vessel, (i) means for introducing pulp into said feed zone, and (j) means for removing pulp from said flotation vessel.

11. A flotation process comprising:

(a) providing a flotation vessel, (b) providing a vertical baffle inside said vessel and spaced from a wall of said vessel and defining a flotation zone between said baffle and said wall which has a substantially uniform cross sectional area, the lower end of said baffle being spaced from the bottom of the vessel thereby defining a passage through which pulp can flow into said flotation zone, the upper end of the baffle being spaced below the upper edge of the vessel wall thereby defining an upper passage for pulp to flow over the top of the baffle and into a feed zone, said feed zone being located in said vessel adjacent said flotation zone and separated therefrom by said vertical baffle;

(c) providing a uniform flow plate with holes therein at the lower end of said flotation zone;

(d) feeding a mineral pulp into said feed zone, (e) circulating said pulp downwardly through said feed zone and through said lower passage and upwardly through said uniform flow plate to establish a substantially uniform upward flow in said flotation zone;

(f) introducing gas bubbles into said circulating pulp; and (g) removing a froth discharge created during said flotation process from directly above the flotation zone.

12. The process as claimed in claim 11 further comprising the step of varying the amount of said gas bubbles.

13. The process as claimed in claim 11 further comprising the step of varying the velocity of said uniform upward flow within said flotation zone.

14. The process as claimed in claim 11, further comprising the step of varying the velocity of said froth discharge.

* * * * *